United States Patent [19]

Sauger

[11] 4,451,022

[45] May 29, 1984

[54] READY PAD FOR CONCRETE

[76] Inventor: Lawrence M. Sauger, 2146 Parliament, Sterling Heights, Mich. 48077

[21] Appl. No.: 366,365

[22] Filed: Apr. 7, 1982

[51] Int. Cl.[3] ..... B28B 7/04

[52] U.S. Cl. ..... 249/2; 249/4; 249/5; 249/28; 249/53 R; 249/158; 249/165; 249/171

[58] Field of Search ..... 249/2, 3, 4, 5, 6, 7, 249/171, 28, 158, 165; 33/379

[56] References Cited

U.S. PATENT DOCUMENTS

| | | | |
|---|---|---|---|
| 788,481 | 4/1905 | Lightner | 249/158 X |
| 824,235 | 6/1906 | Damon | 249/158 X |
| 896,330 | 8/1908 | Scheelky | 249/158 X |
| 955,474 | 4/1910 | Ramey et al. | 249/5 |
| 968,285 | 8/1910 | Streator | 249/158 X |
| 1,008,395 | 11/1911 | Ubbink | 249/158 X |
| 1,067,420 | 7/1913 | Forbis | 249/5 |
| 1,635,093 | 7/1927 | McPherson et al. | 249/170 X |
| 1,637,998 | 8/1927 | Heltzel | 249/5 |
| 1,644,584 | 10/1927 | Heltzel | 249/5 |
| 1,644,586 | 10/1927 | Heltzel | 249/6 X |
| 2,190,801 | 2/1940 | Otto | 249/158 X |
| 2,610,380 | 9/1952 | Pollman | 249/165 X |
| 3,009,254 | 11/1961 | Youngs | 33/379 |

*Primary Examiner*—Thomas P. Pavelko
*Assistant Examiner*—James C. Housel
*Attorney, Agent, or Firm*—Markell Seitzman

[57] ABSTRACT

A reusable form for a formed in place concrete pad positioned near a structure. The form including two spaced side beams of a predetermined length beam having first and second ends, each of the first ends are adapted to engage the structure in an abutting relation. The form further including a front beam engaging the side beams at said second ends; a pin hinge for connecting the front beam to the side beams proximate the second ends; and transverse stabilizer means mounted to and suspended above the side beams for establishing a parallel spacing between the side beams for squaring or establishing a perpendicular relation between the side beams and the front beam.

2 Claims, 6 Drawing Figures

READY PAD FOR CONCRETE

BACKGROUND AND SUMMARY OF THE INVENTION

The invention relates to an improved form for poured concrete and more specifically, to a reusable form having prefabricated elements.

Of the many problems confronting electrical contractors and fabricators of on site concrete pads or forms or similar pads for transformers or swimming pool filters is the lack of the prefabricated, presized, reusable, durable concrete forms having a self-squaring capability meeting the size and placement specifications imposed by end users such as electric utility companies. Electrical transformers and the like used for commercial industrial and multiple housing structures are required by most utilities to be mounted on poured-in-place concrete pads which conform to rigid specifications. Heretofore, it has been necessary for the contractor to construct from lumber a new form for each concrete pad. Radcliff et al, U.S. Pat. No. 3,917,214 is an example of a flying form using laminated wood joists. Wooden forms lack durability, simplicity and the self-squaring feature of the present invention. These wooden forms often utilize complicated configurations of the wooden components in an attempt to enhance the structural strength of the components parts. The prior art further illustrates forms which utilize complicated and expensive means for securing the form components parts together. These means for securing often include specially formed pins, bolts and swingable clamps as illustrated by Landoski in U.S. Pat. No. 4,159,100 and by Echterling in U.S. Pat. No. 2,234,335.

The purpose of the present invention is to provide a prefabricated concrete form that is to simple construction, that uses readily available parts and permits the on site assembly of concrete forms to a predetermined size and permits the placement of a poured-in-place concrete pad at a determinable orientation or position from a structure such as the side of a building or swimming pool. It is an object of the present invention to provide a reusable concrete form overcoming the deficiencies of the prior art. It is another object of the present invention to provide a reusable concrete form thus avoiding the waste of materials required in manufacturing new pads for each application, and also avoiding the waste of the time needed to construct a new form for each concrete pad. A further object of the present invention is to provide a concrete form that is premeasured to meet existing use specifications thus making it unnecessary to precisely measure, align and level each form prior to pouring of the concrete. A further object of the present invention is to provide a form having a self-squaring capability as well as to provide a form that is easily removed so as not to damage the concrete pad. A further object of the present invention is to provide a form having an elevated stabilizing member so that the screeding or surface finish of all the concrete is not impeded.

Accordingly, the preferred embodiment of the invention includes: a resuable form for a formed in place concrete pad positioned near a structure comprising: two spaced side beams of a predetermined length beam having first and second ends, each of the first ends are adapted to engage the structure in an abutting relation; a front beam engaging the side beams at the second ends; connecting means for connecting the front beam to the side beams proximate the second ends; and transverse stabilizer means mounted to and suspended above the side beams for establishing a parallel spacing between the side beams and for squaring or establishing a perpendicular relation between the side beams and the front beam. In an alternate embodiment of the invention an end beam is mounted below the transverse stabilizer means having first and second ends for engaging one of each of the side beams in abutting relation; and securing means for joining the transverse stabilizer means to the end beam in a spaced apart relation.

DETAILED DESCRIPTION OF THE DRAWINGS

Figure 1:
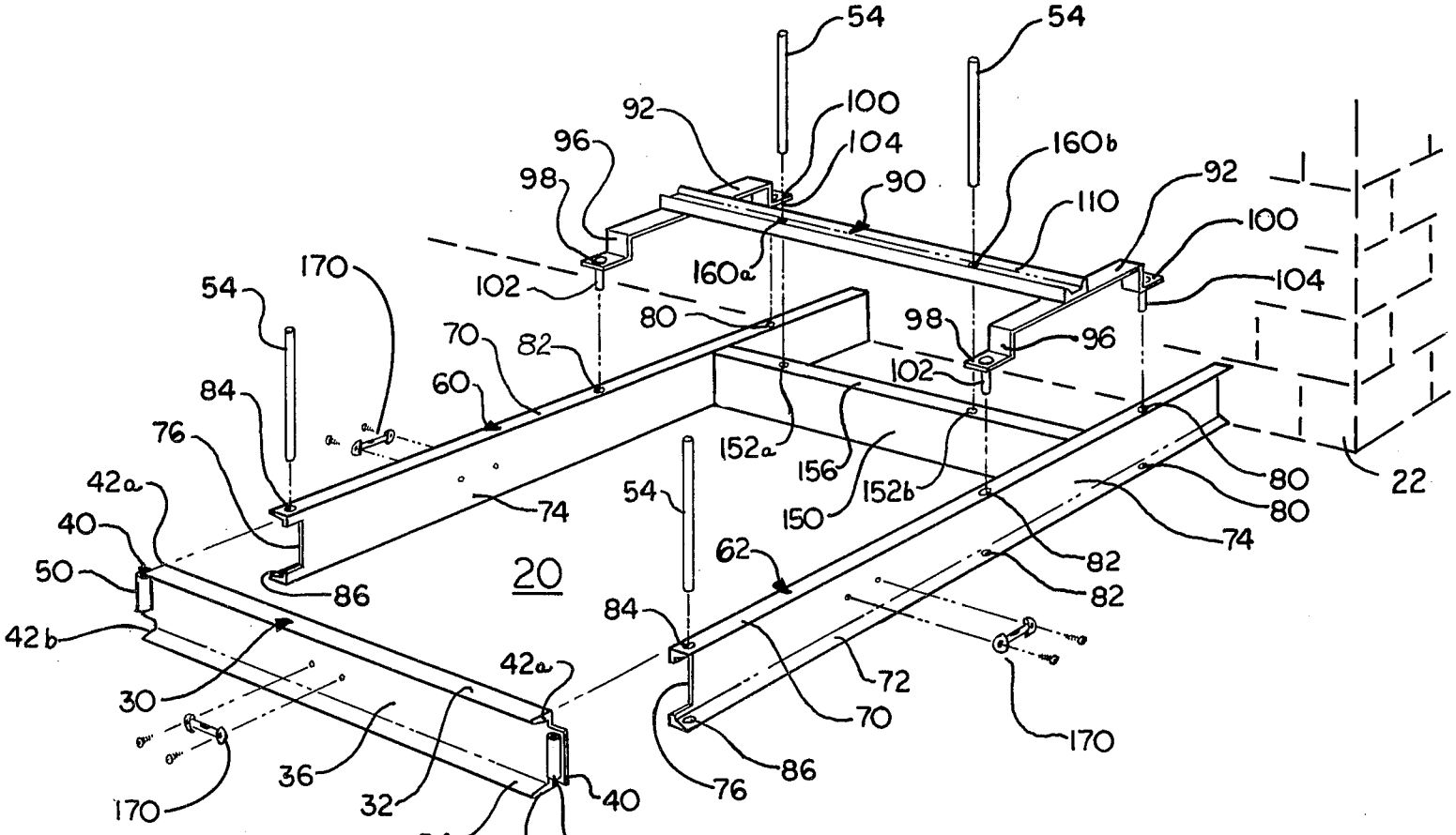
FIG. 1 is a perspective view of my invention.
Figure 6:
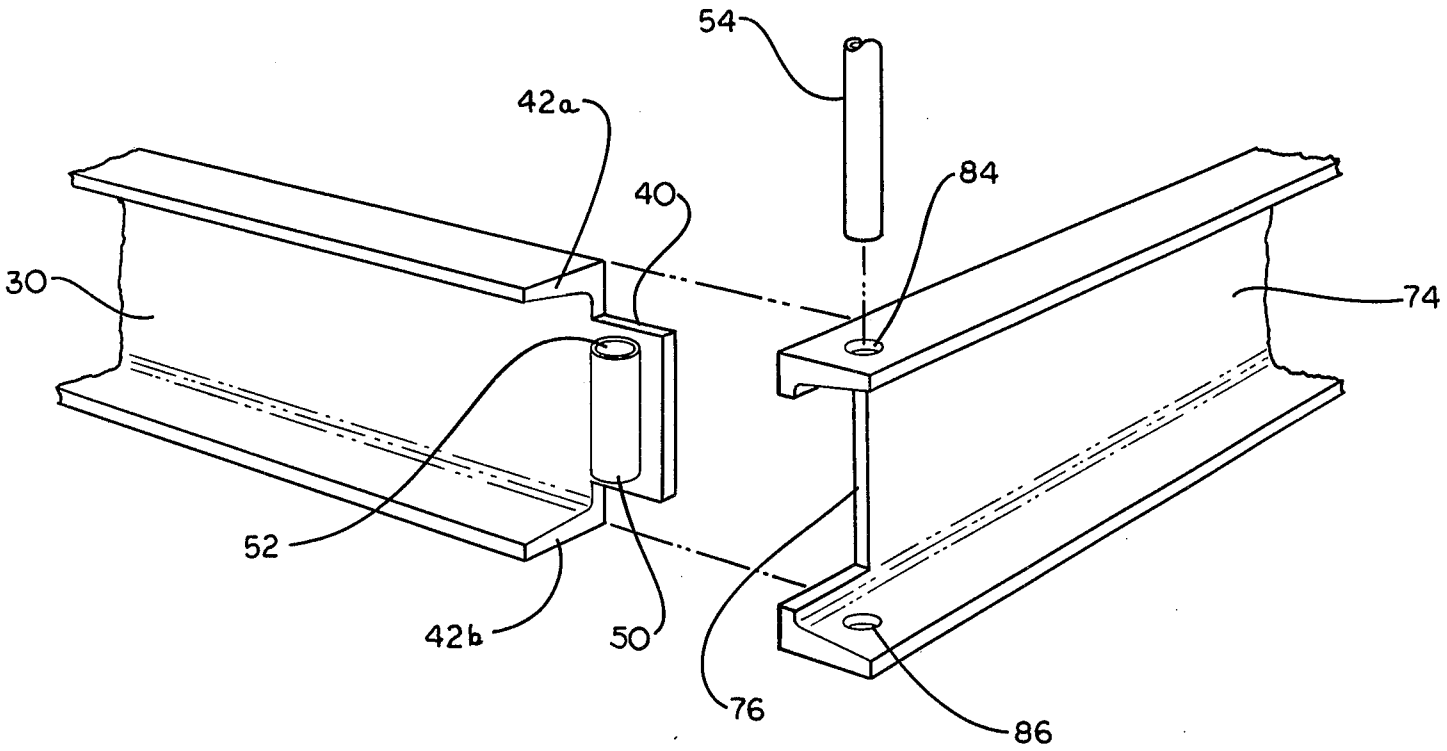
FIG. 6 is a partial perspective view of the front and side beam corner assembly.

Reference is made to Figures and in particular FIG. 1 which illustrate a concrete form 20 positioned in abutting engagement to a structure 22 (shown in phantom line) such as a building or swimming pool. The form 20 includes a front beam 30. The front beam is preferably fabricated of coated aluminum beams having a U-shaped cross-section having a top 32, a bottom 34 and a vertically positioned side 36. The front beam further includes a projecting or extending member 40 on each of its ends. As illustrated in FIG. 1, the projecting member 40 comprises an extension of the vertical side 36 beyond its corresponding top and bottom 32 and 34, respectively. The edges 42*a* and b of the top and bottom (32, 34) extend perpendicularly from their respective projecting member 40. A pipe or hollow conduit 50 is welded or otherwise attached in a vertical orientation to each of the projecting members 40. The opening 52 shown in FIG. 6 of each hollow conduit 50 is sized to accept pin means 54. It is contemplated that the pin means 54 will be a piece of standard electrical conduit having a three-quarter inch outside diameter. This conduit is a standard item utilized by electrical contractors and is readily available at many construction sites. It should be appeciated that a U-channel member is not a necessary ingredient of the present invention. The U-channel front beam 30 may be replaced by a beam having a simple rectangular cross-section. The invention further includes a pair of side beams 60 and 62. The length of the side beams 60 and 62, respectively is a predetermined size, thus fixing the distance between the inside of the front beam 30 to the structure 22. In its preferred embodiment, the side beams 60 and 62 are coated aluminum having a U-shaped cross section formed by a top 70, a bottom 72 and a side element 74 connecting the bottom and top 70 and 72 respectively. Each of the side beams 60 and 62 further includes at an end opposite the structure a notch or cut-out 76 fabricated in the side member 74. The width of the notch 76 is sized to accept the projecting member 40. Each of the side beams 60 and 62 further includes a pair of openings 84 and 86 fabricated in their respective top and bottom members 70 and 72. These openings serve as alignment holes. When the form 20 is assembled, the openings 84 and 86 are positioned in registry over each pipe or hollow conduit 50 such that the pin means 54 may be inserted therethrough to provide a pin type of connection between the front 30 and side beams 60 and 62. Each of the side beams 60 and 62 further include a pair of openings 80 and 82 formed in the top 70 or bottom 72. These openings 80 and 82 are sized to receive the pins of the transverse stabilizer 90 as described below.

Figure 2:
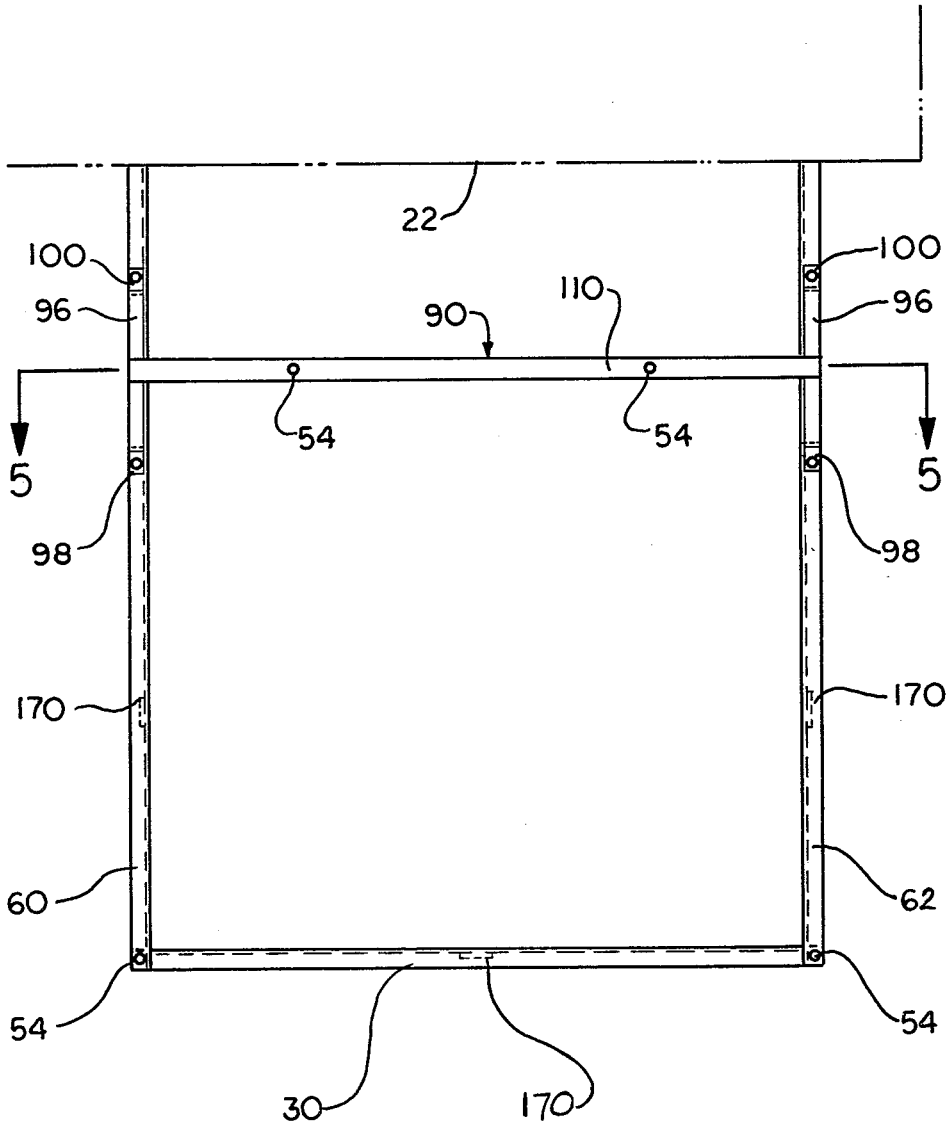
FIG. 2 is a vertical plan view of a concrete form fabricated in accordance with my invention.
Figure 3:
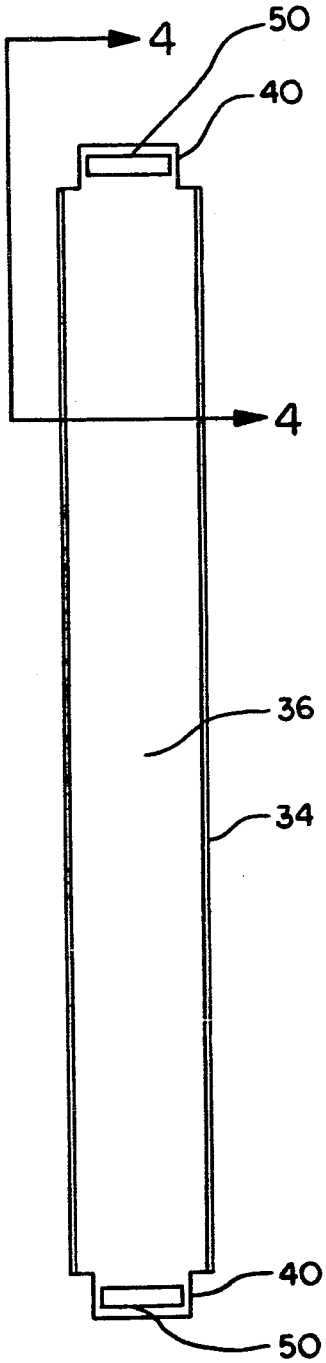
FIG. 3 is a plan view of the front beam shown in FIG. 1 or 2.
Figure 4:
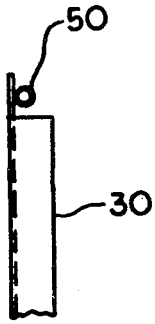
FIG. 4 is a partial sectional view through section 4—4.
Figure 5:
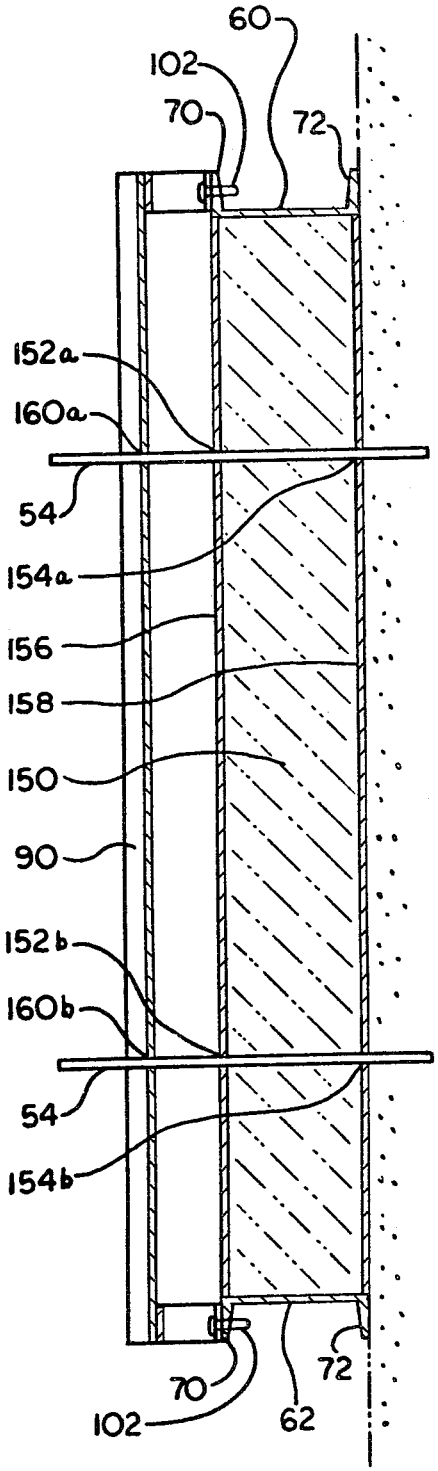
FIG. 5 an end view illustrating the orientation of an optional end beam to the other components of the form.

The present invention further includes the transverse stabilizer 90 which bridges and links the side beams 60 and 62, precisely spaces the side beams thereapart and further squares the side beams 60 and 62 with respect to the front beam 30. The transverse stabilizer is shown in FIGS. 1, 2 and 5. The transverse stabilizer 90 includes a pair of bilevel connecting members 92. Each of the connecting members 92 includes a C-shaped central member 96 and a pair of flanges 98 and 100 extending outwardly therefrom. The underside of each of the flanges has a pin 102 and 104 extending therefrom. These pins may be heli-arced in place or mechanically attached. The positioning of the pins on each of the respective flanges 98 and 100 permits the insertion of the pins 102 and 104 into their respective mounting holes 80 and 82. A transverse beam 110 is connected to each of the central members 96 and is positioned in an elevated orientation above the tops 70 of the side beams 60 and 62 respectively. In this manner, by providing a transverse stabilizer 92 having a transverse beam 110 positioned above the tops 70 of the side beams 60 and 62 it is thereby possible to pour concrete into the assembled form 20 and provide a clearance gap between the transverse beam 110 and the surface of the concrete. This gap is extremely useful since it provides the necessary space to permit the screeding of the poured concrete. Screeding of poured concrete is a common and often necessary practice and is done to rough level the poured concrete and to float or position the larger stones carried within the concrete below the surface; thus leaving a relatively smooth surface finish.

In operation, each of the side beams 60 and 62 would be placed in abutting relationship to the structure, building or swimming pool 22. The projecting members 40 of the front beam are then inserted within the corresponding notch or cut-out 76 of a side beam 60 or 62. The pin means or electrical conduit 54 is then inserted within the holes 84 and 86 and through the hollow conduit 50, thus securing the front beam to the side beams. The transverse stabilizer 90 is then mounted in its corresponding alignment holes (80, and 82) thus precisely spacing the side beams therebetween and insuring the squareness of the overall form. Concrete is then poured into the form 20 filling the entire space between the structure 22 and the interior of the sides 36 and 74 of the front and side beams. The above assumes that the optional end beam 150 is not used. The pin means or conduits 54 can be chosen to be long enough so as to enable them to be driven or staked into the ground to prevent movement of the form 20 away from the structure 22.

In certain applications, the present invention can be utilized to provide a poured-in-place concrete pad that is positioned apart from the structure as opposed to the above described use that yields a pad that is in an abutting relation to the structure. Reference is now made to FIGS. 1, 2 and 5 which illustrate the alternate embodiment of the transverse stabilizer means that accomodates a rear beam 150. In this embodiment of the invention, a rear beam 150 preferably having a U-shaped cross section is positioned level and the tops 70 of the side beams 60 and 62 and below the transverse stabilizer means 90. The rear beam 150 further includes two pair of holes 152i a and *b* and 154*a* and *b* fabricated in its top 156 and bottom 158 elements. The transverse beam 110 further includes a pair of alignment holes 160*a* and *b* positioned above the holes 154 and 152. In this manner, the end beam 150 is first inserted between the side beams 60 and 62 and the transverse stabilizer 90 is positioned in place above the rear beam 150. Upon insertion of the pins 102 and 104 into the alignment holes 80 and 82, pin means 54, preferably electrical conduit, is inserted within each alignment hole 160 and extends through the holes 152 and 154 in the rear beam 150 into the ground, thus positioning the interior side of the side beam 150 vertically with respect to the transverse beam 110 and perpendicularly with respect to the interior of the side beams 60 and 62. In this manner, by incorporating an end beam 150 below the transverse stabilizer 90, the form area is prepositioned at a prespecified distance from the building or structure 22. In addition, by pinning the end beam 150 to the transverse stabilizer in the abovementioned manner, the surface of the concrete will be maintained below the transverse beam 110 thus insuring sufficient distance therebetween to permit screeding as previously described. The distance between the end beam 150 and the structure 22 can of course be modified by changing the positioning of the pin alignment holes 80 and 82 or by providing additional holes (not shown). Finally, the leveling of each of the beams of the form 20 can be accurately achieved by incorporating upon the front beam 30 and side beams 60 and 62 a leveling apparatus generally designated as 170 such as a mono-vial level.

Many changes and modifications in the abovedescribed embodiments of the invention can, of course, be carried out without departing from the scope thereof. Accordingly, that scope is intended to be limited only by the scope of the appended claims.

Having thus described the invention, what is claimed is:

1. A reusable form for a formed in place concrete pad comprising:

two spaced side beams of a predetermined length having first and second ends, each of said side beams comprising a flat first side portion, and flat top and bottom portions extending perpendicularly from said first side portion;

a front beam engaging said side beams at said second ends including a flat second side portion and flat top and bottom portions extending perpendicularly from said second side portion;

connecting means for connecting said front beam to said side beams proximate said second ends and for aligning the respective top portions of said side beams and said front beam in co-planar relation;

transverse stabilizer means mounted to and suspended above said side beams for establishing a parallel spacing between said side beams and for squaring and establishing a perpendicular relation between said side beams and said front beam including a transverse beam having at least two apertures therethrough;

mounting means for securing said transverse beam to each of said side beams in a spaced apart relation from the respective said tops of each of said side beams, wherein said mounting means comprises: an upraised central portion, adapted to engage said transverse beam, a pair of lower flange members extending down and outwardly from said central portion, a pair of mounting pins, one each extending downward for a respective one of said lower flange members; and wherein each of said side beams includes second and third alignment holes adapted to receive said respective pair of said mounting pins;

an end beam mounted below said transverse stabilizer means having first and second ends for engaging one of each of said side beams in abutting, level relation and apertures, equal in number to the apertures in said transverse beam and aligned therewith, said apertures in said end beam extending therethrough; and a pin received through each of said apertures of said transverse beam and extending through the corresponding apertures of said end beam for securing said end beam to said transverse beam.

2. The form as defined in claim 1 wherein said transverse stabilizer means and said end beam are positioned a predetermined distance from said first ends of said side beams.

* * * * *